US009839835B1

(12) United States Patent
Zaring

(10) Patent No.: US 9,839,835 B1
(45) Date of Patent: Dec. 12, 2017

(54) STANDUP PADDLE-BOARD SKATEBOARD APPARATUS

(71) Applicant: Keith Zaring, Centennial, CO (US)

(72) Inventor: Keith Zaring, Centennial, CO (US)

(73) Assignee: AKZ PADDLE COMPANY, INC., Centennial, CO (US)

( * ) Notice: Subject to any disclaimer, the term of this patent is extended or adjusted under 35 U.S.C. 154(b) by 0 days.

(21) Appl. No.: 15/212,268

(22) Filed: Jul. 17, 2016

(51) Int. Cl.
*A63C 17/01* (2006.01)

(52) U.S. Cl.
CPC ..... *A63C 17/012* (2013.01)

(58) Field of Classification Search
CPC ..... A63C 17/00; A63C 17/01; A63C 17/011; A63C 17/012; A63C 17/013; A63C 17/015
See application file for complete search history.

(56) References Cited

U.S. PATENT DOCUMENTS 4,029,330 A * 6/1977 Runyan, Jr. ..... A63C 17/0086 280/11.27
4,060,253 A * 11/1977 Oldendorf ..... A63C 17/0046 280/11.28
4,127,282 A * 11/1978 Gorlach ..... A63C 17/0046 188/29
4,134,599 A * 1/1979 DiMille ..... A63C 17/01 188/29
D252,346 S * 7/1979 Solheim ..... A63C 17/01 D21/765
4,176,850 A * 12/1979 Johnson ..... A63C 17/0046 280/11.28
4,180,278 A * 12/1979 Gottlieb ..... A63C 17/01 280/11.28
4,235,448 A * 11/1980 Thomas ..... A63C 17/01 280/842
4,596,396 A * 6/1986 Merbler ..... A63C 17/02 280/11.28
5,114,166 A * 5/1992 McCosker ..... A63C 17/0046 280/11.28
5,927,732 A * 7/1999 Snyder ..... A63C 17/01 280/87.01
D413,954 S * 9/1999 Gerlach ..... A63C 17/01 D21/765
6,145,857 A * 11/2000 Bernstein ..... A63C 17/0006 280/11.208
D483,087 S * 12/2003 Greenhalgh ..... A63C 17/01 D21/765

(Continued)

OTHER PUBLICATIONS

Loaded Boards; https://www.silverfishlongboarding.com/gear-reviews/longboard/loaded-longboards/loaded-fish, Admitted prior art as of Jul. 17, 2016.

*Primary Examiner* — Hau V Phan
*Assistant Examiner* — Jacob B Meyer
(74) *Attorney, Agent, or Firm* — Rocky Mountain Patent, LLC

(57) ABSTRACT

A standup paddle-board skateboard apparatus for mimicking the experience of standup paddle-boarding on land. Functional elements of the apparatus may include wheel-cutouts allowing for increased articulation without experiencing wheel-bite, a modified truck angle for improved turning, central handle, and axle cutouts allow for increased board tilt without the axle impacting the board.

7 Claims, 2 Drawing Sheets

(56) References Cited

U.S. PATENT DOCUMENTS

| | | | | |
|---|---|---|---|---|
| 7,040,638 | B2 * | 5/2006 | Cole | A63C 17/12 180/181 |
| 7,226,063 | B2 * | 6/2007 | Paddock | A63C 17/01 280/11.28 |
| D620,994 | S * | 8/2010 | Jordan | A63C 17/01 D21/765 |
| D629,859 | S * | 12/2010 | Buksa | A63C 17/01 D21/765 |
| 8,459,670 | B1 * | 6/2013 | Tizzone | A63C 17/015 280/87.042 |
| 8,550,480 | B1 * | 10/2013 | Bonilla | A63C 17/012 280/87.042 |
| 8,608,182 | B2 * | 12/2013 | Mete | A63C 17/012 280/11.19 |
| D705,372 | S * | 5/2014 | Harris | A63C 17/01 D21/765 |
| 8,857,831 | B1 * | 10/2014 | Rotondo | A63C 17/012 280/11.27 |
| 9,010,777 | B2 * | 4/2015 | Braden | A63C 17/012 280/11.28 |
| 9,022,398 | B1 * | 5/2015 | Harris | A63C 17/01 280/87.042 |
| 9,033,753 | B2 * | 5/2015 | Siverts | B63B 35/7959 114/39.11 |
| 9,248,367 | B2 * | 2/2016 | Imbrie | A63C 17/002 |
| D751,160 | S * | 3/2016 | Tian | A63C 17/01 D21/765 |
| 9,302,173 | B2 * | 4/2016 | DiCarlo | A63C 17/12 |
| 9,387,388 | B2 * | 7/2016 | King | A63C 17/12 |
| D770,585 | S * | 11/2016 | Desberg | A63C 17/01 D21/765 |
| 9,555,314 | B2 * | 1/2017 | Groenenboom | A63C 17/012 |
| 2008/0042387 | A1 * | 2/2008 | Lesko | A63C 17/01 280/87.042 |

* cited by examiner

STANDUP PADDLE-BOARD SKATEBOARD APPARATUS

FIELD OF THE INVENTION

The present invention pertains in general to a skating platform with a particular shape for the purposes of allowing a user to stand abreast the longitudinal axis of the skating platform. The ability to steer the skating platform while standing abreast of the skateboard allows a user to mimic the activity that has come to be appreciated as stand-up paddle-boarding.

BACKGROUND OF THE INVENTION

Originally known as sidewalk-surfing, skateboarding is believed to have been conceived initially in the late 1940's or early 1950's as a surfer's pastime for when the surf was flat. Today skateboarding is considered an action sport and recreational activity surrounding an estimated market of 11.08 million active skaters and $4.8 billion in annual revenue.

The construction of the modern skateboard involves a platform on which a user stands referred to as a "deck," and a pair of two-wheeled axle assemblies commonly known as "trucks."

Trucks are the axle assemblies that allow a rider to steer the skateboard through shifting his or her weight. Trucks have an axle or axle hanger that pivots in relation to a baseplate with each end of the axle having an affixed wheel. The two trucks are affixed to the bottom of the deck, one near the front and the other near the back end of the deck, spanning the deck. The trucks are affixed so the axles are perpendicular to the midline and the path of travel. The assembly of the truck allows the axle to pivot about a pivot-axis to generate coordinated perpendicular and parallel articulation of the axle in relation to the deck. The perpendicular articulation of the truck causes deck tilt across the midline, which is beneficial to a rider remaining on the deck while navigating a turn. The parallel articulation causes axle rotation, which further causes the axle to no longer remain perpendicular to the midline. The offset angle of the axle from perpendicular causes the skateboard to take a different path of travel. It will be appreciated that higher levels of perpendicular articulation results in higher angles of tilt, while higher levels of parallel articulation result in higher offset angles translating to tighter turning capability.

The general construction of a truck assembly includes a baseplate that has provisions for the constraint of an axle at two points. These two points of constraint, coincident with the pivot-axis are a pivot point and a threaded rod referred to as a king-pin. One portion of the axle hanger is inserted into the pivot recess and another portion of the axle hanger has an aperture, which is placed over the king-pin with a semi-elastic bushing placed on either side of the aperture. A nut is then threaded over the open end of the king-pin to compress the semi-elastic bushings. The compression level and elasticity of the bushings control the ease of articulation.

The baseplate angle is the main influencing factor in how much parallel articulation trucks have in relation to perpendicular articulation. It is known to those skilled in the art that the baseplate angle is the angle about which the pivot-axis that the axle articulates. A baseplate angle of 0-degrees would result in a truck having only perpendicular articulation. A 90-degree baseplate angle would result in a truck having only parallel articulation. A 45-degree angle would result in a truck having a 1:1 perpendicular to parallel articulation ratio.

Skateboards vary in size and purpose. Some skateboards may have a more rigid deck with trucks that provide less articulation suitable for trick riding. Other skateboards, such as "longboard" skateboards, are intended to act more like a surfboard. Longboard skateboards typically have longer and more flexible decks and trucks that allow for more articulation. Longboards also typically have a larger baseplate angle as the longer deck needs maneuverability. Many longboards use trucks with a baseplate angle in excess of 45-degrees to allow for increased maneuverability. A standard baseplate angle for a longboard truck is typically between 50-degrees and 52-degrees.

SUMMARY OF THE INVENTION

The industry surrounding the practice of standup paddle-boarding, a water-based sport, has expanded in recent years. Standup paddle-boarding, also referred to as paddle-boarding, involves standing on an apparatus similar to a surfboard while propelling oneself with a paddle. When standing on a standup paddle-board, common practice involves standing with a first foot entirely on a first side of a midline, a second foot entirely on the opposite side of the midline. Typically the user stands with their feet placed so his or her stance is perpendicular to the midline. The midline extends from the center of the nose of the paddleboard to the center of the tail of the paddleboard. The expansion and interest surrounding standup paddle-boarding has grown to encompass skateboards. However, the problems surrounding skateboards mimicking the activity of standup paddle-boarding are many.

Some existing solutions to mimicking standup paddle-boarding simply add the use of a paddle-like apparatus. In such solutions, the user propels his or herself by pushing the paddle-like apparatus against the ground and pushing rearward. However, as typical skateboards do not have a deck wide enough to stand with a foot entirely on either side of the midline, these fail to provide a similar experience.

Certain existing solutions to mimicking standup paddle-boarding surround the use of a skateboard dimensioned to the typical size of a stand-up paddleboard. This is an impractical solution to many as the size precludes them from easily transporting the skateboard to a location, which they wish to use the skateboard.

Certain existing solutions intended to mimic standup paddle-boarding skateboards involve the use of a deck with increased width. The problem with a deck of increased width surrounds a phenomenon known as wheel-bite. Wheel-bite occurs when the wheel of a skateboard contacts the underside or sides of the deck and abruptly stops. When a skateboard stops abruptly, the rider can be thrown from the skateboard leading to potential injury.

Some skateboards attempt to solve the problem surrounding wheel-bite with recesses cut partially through the thickness of the skateboard deck. However, the recesses do not allow for full clearance of the wheels. Other skateboard decks attempt to accommodate radius cuts from the sides of the deck, however these do not accommodate the increased parallel articulation typical of trucks used with longboard skateboards.

Some solutions attempt to solve the problems surrounding wheel-bite by using axles with extended length. Skateboards that have extended length axles with wheels that extend beyond the lateral extents of the deck are prone to accidents associated with wheels contacting objects such as curbs causing the skateboard to stop suddenly and potentially throwing the rider from the skateboard.

Furthermore, the problem with many skateboards intended to mimic the paddle-boarding experience have a problem with a wider deck contacting the ground. At full articulation, the tilt of the deck causes the lateral extents of the deck to contact the ground, potentially damaging the deck or losing traction, which may lead to injury of the rider.

Another problem associated with skateboards intended to mimic the paddle-boarding experience surrounds braking. Most skateboard riders are in the practice of braking, or slowing down the rate of travel, by balancing with one foot on the deck and removing one foot from the deck while moving to place it on the ground. The rider may modulate the amount of weight they place upon this foot in contact with the ground to increase or decrease their rate of deceleration. Neither a skateboard with increased width, nor a typical standup paddle-boarding stance, allow a rider to maintain balance while placing one foot on the ground while moving. Embodiments of the invention include wheel cutouts that allow the placement of a rider's foot on the deck directly fore or aft of a spinning wheel. The cutouts allow a support surface for a rider to place the heel of one foot on the deck while rotating their foot downward to place pressure on a spinning front wheel while in motion. Likewise, the rider may alternatively place a foot with his or her toes in contact with the deck while rotating their foot downward to place pressure on a spinning back wheel while in motion. The use of wheel cutouts allow the rider to slow the rate of travel while maintaining balance aboard the standup paddle-board skateboard.

Certain embodiments of the invention include a deck with cutouts allowing a user to place their foot on the deck in proximity directly fore or aft of a wheel of the standup paddle-board skateboard. This provides increased controllability of foot braking.

Certain embodiments of the invention as disclosed herein use a wedge to modify the baseplate angle to increase the parallel articulation of the trucks and decrease the perpendicular articulation of the trucks. The increased parallel articulation to perpendicular articulation ratio decreases the tilt of a deck when turning. This increased ratio allows a wider deck to be used without the lateral extents of the deck contacting the ground at maximum tilt.

DETAILED DESCRIPTION

Figure 1A:
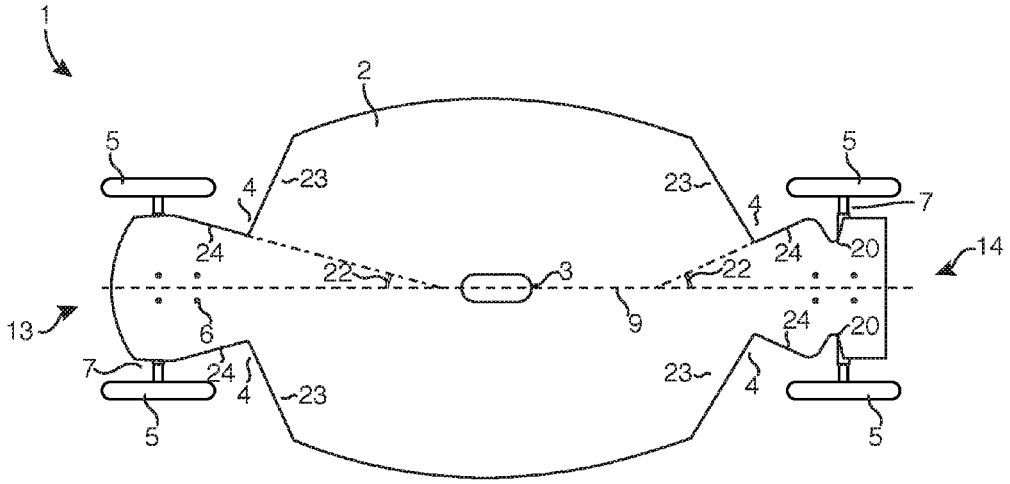
FIG. 1A—Top view of a standup paddle-board skateboard in certain embodiments.
Figure 1B:
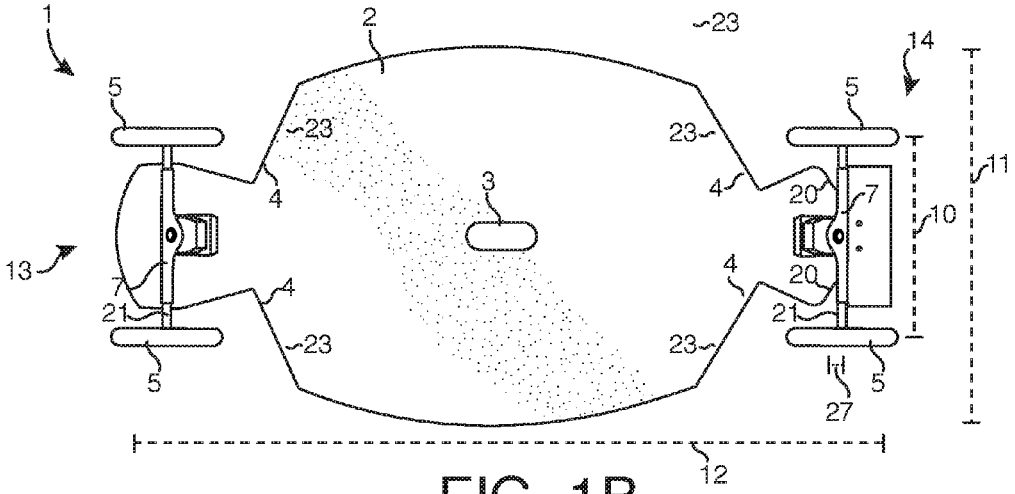
FIG. 1B—Bottom view of a standup paddle-board skateboard in certain embodiments.

Referring to an exemplary embodiment shown in FIG. 1A and FIG. 1B, a standup paddle-board skateboard 1 includes a deck 2 with mounted truck assemblies 7. The truck assemblies 7 further comprise attached wheels 5. Fasteners 6 secure the truck assemblies 7 to the deck 2.

Figure 2:
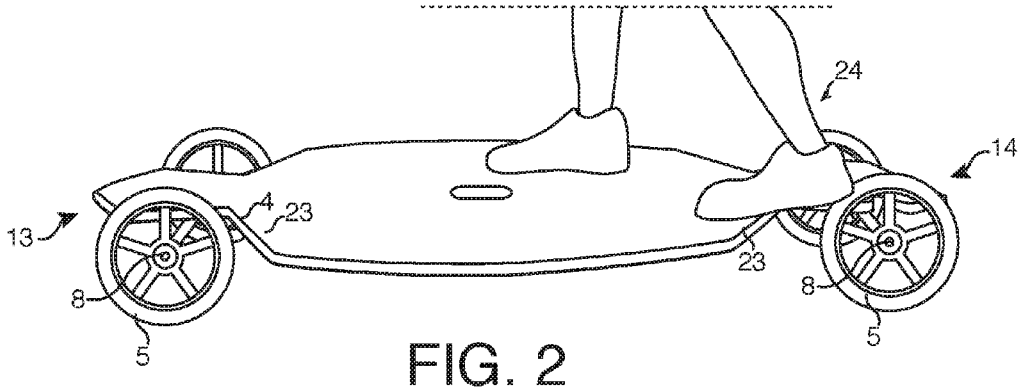
FIG. 2—Side perspective view of a standup paddle-board skateboard in certain embodiments.
Figure 3A:
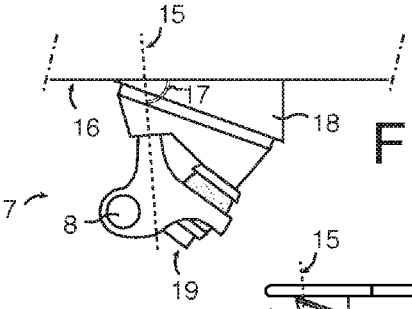
FIG. 3A—Side view of a truck mounted on a leading distal end of a standup paddle-board skateboard embodiment.

Referring to FIG. 3A, a skateboard truck assembly 7 is mounted on the lower planar surface 16 of a deck, such that the pivot-axis 15 forms a pivot-axis angle 17 that is between 55-degrees and 90-degrees from the plane of the deck. In certain embodiments this angle is established, for example, by mounting a wedge 18 between a skateboard truck assembly 7 and the lower surface 16 of the deck, such that the pivot-axis angle 17 is set to 55-degrees to 90-degrees. In certain embodiments, it is preferable to set a pivot-axis angle between 70-degrees and 80-degrees. For reference, a king-pin 19 is shown in FIG. 3A, and a wheel axle 8 is shown in FIG. 2 and FIG. 3A.

Figure 3B:
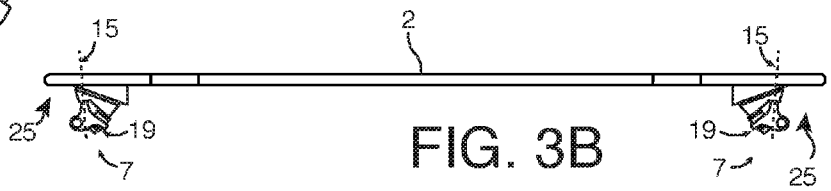
FIG. 3B—Side view of trucks mounted on a standup paddle-board skateboard embodiment.

Referring to FIG. 3B, the skateboard truck assemblies 7 are mounted such that the pivot axis 15 of the truck assemblies are located near the distal ends 25, and the king-pins 19 of the truck assemblies are directed away from the middle of the deck 2.

In certain embodiments, a rider shifts his or her weight on either side of a midline 9 (as shown for example in FIG. 1A) to steer the standup paddle-board skateboard 1. Referring to FIG. 1A, FIG. 1B, FIG. 4A, and FIG. 4B, a deck includes wheel cutouts 4 located on both a leading distal end 13 and a trailing distal end 14. It will be appreciated that a leading distal end and a trailing distal end may also be referred to as a distal end. Referring to FIG. 1A, and FIG. 1B, a ledge 23 is located adjacent to a wheel cutout 4 on the deck 2, where a ledge provides a surface for foot placement.

Figure 4A:
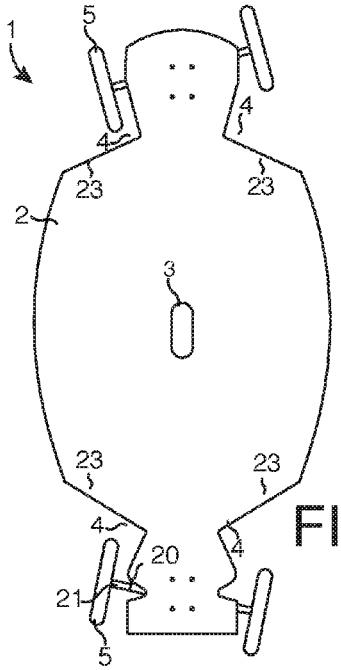
FIG. 4A—Top view of a skating platform when steering to the left in certain embodiments.
Figure 4B:
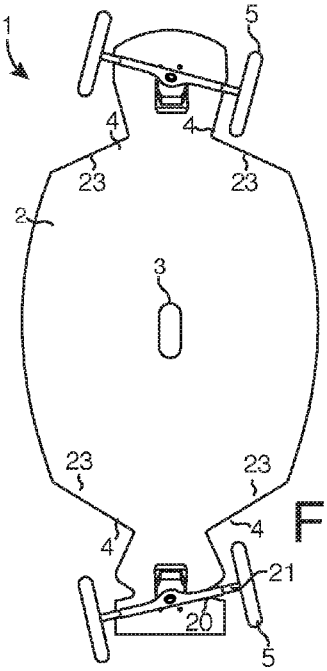
FIG. 4B—Bottom view of a skating platform when steering to the left in certain embodiments.
Figure 5:
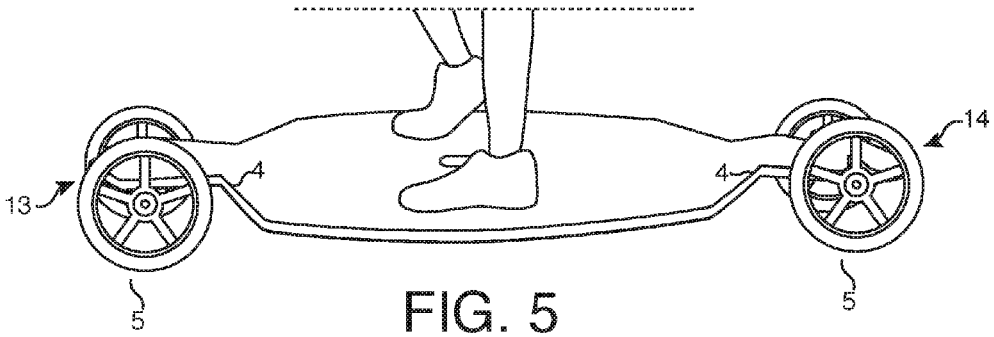
FIG. 5—Side view of a skating platform when steering to the left in certain embodiments.

As seen in FIG. 4A, FIG. 4B, and FIG. 5, certain embodiments of the wheel cutouts 4 accommodates the profile of the wheel 5 when a truck assembly 7 is under full parallel articulation. Referring to FIG. 1A, a wheel cutout 4 has a side 24 that is positioned at an angle 22 that is between 20-degrees and 35-degrees from the midline 9. It will be appreciated that in certain embodiments, a side 24 has an angle that is between 0-degree and 20-degrees from the midline 9. Certain embodiments of a wheel cutout 4, as seen in FIG. 1B, are located such that a distal portion of the wheel cutout 4 begins between an axle 21 and a portion of a wheel 5, attached to the axle 21 closest to the center portion of the deck.

A wheel cutout 4 has a number of benefits during use of a standup paddle-board skateboard 1. An advantage is that a large diameter wheel can be mounted to the truck assemblies, providing the rider stability and a smoother ride on irregular surfaces. Another advantage is that it allows a rider to increase the parallel articulation of the wheels thus turning a tighter radius, while mitigating the effects of wheel bite. A further advantage is that a wheel cutout 4 preserves the overall surface area of the deck 2. In one example as shown in FIG. 2, a rider may brake by placing a foot 24 on a ledge 23 in front of a spinning wheel 5, and lowering the heel onto the wheel. It will be appreciated that a ledge 23 provides the required surface area to place a foot fore or aft a spinning wheel 5 to foot-brake. It will be appreciated that foot-braking may occur in conjunction with any wheel 5 proximate to either the leading distal end 13 or a trailing distal end 14.

Further referring to FIG. 4A and FIG. 4B, certain embodiments of a deck 2 include axle cutouts 20 that provide clearance for the axle 21 while turning. As shown in FIG. 1B, certain embodiments of an axle cutout 20 is placed at a distance 27 of approximately 2.5 cm (1 inch) offset forward from a truck assembly 7 axle. Referring to FIG. 1A, in certain embodiments, an axle cutout 20 is located on either side of a midline 9 at a trailing distal end 14 of a deck 2. It will be appreciated that in certain embodiments, axle cutouts 20 are located on both the leading distal end 13 and the trailing distal end 14 of a deck 2.

Referring to FIG. 1A, FIG. 1B, FIG. 4A, and FIG. 4B, certain embodiments of a deck 2 further comprise a handle 3. Certain embodiments of a handle comprise an oblong thru-hole through the deck 2. A handle 3 facilitates carrying the standup paddle-board skateboard 1. It will be appreciated that in certain embodiments, a handle may comprise a device affixed to the top surface or bottom surface of a deck to facilitate easier carrying and handling.

Although a standup paddle-board skateboard 1 may be provided in a number of different sizes, exemplary standup paddle-board skateboards 1 have the following dimensions. Referring to FIG. 1B, in certain embodiments, the truck assembly width 10 ranges from 35.5 cm (14 inches) to 43.5 cm (17 inches), ideally having a width of 39.4 cm (15.5 inches) in certain embodiments. A deck width 11 ranges from 55.5 cm (22 inches) to 66.0 cm (26 inches), ideally having a width of 61.0 cm (24 inches) in certain embodiments. A deck length 12 ranges from 111.5 cm (44 inches) to 132.0 cm (52 inches), ideally having a length of 121.9 cm (48 inches) in certain embodiments.

Certain embodiments have a width that is larger than conventional skateboards. A large width allows a rider to optionally stand on the deck 2 with both feet side-by-side and oriented in a generally parallel direction. Referring to FIG. 1A, in certain embodiments, a rider may stand on the deck by placing their feet on opposite sides of a midline 9. A rider riding a standup paddle-board skateboard 1 handles a paddle-like apparatus, for example, a pole, oar, or paddle, and pushes the paddle-like apparatus downwards and backwards on the ground to propel forward.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "Providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A standup paddle-board skateboard comprising:

a deck, a first truck assembly and a second truck assembly;

said deck comprising a handle;

said deck having a first wheel cutout and second wheel cutout proximate to a first distal end of said deck;

said first wheel cutout and second wheel cutout being equidistant from said first distal end;

said first wheel cutout being coincident with a first lateral side of said deck and said second wheel cutout being coincident with a second lateral side of said deck;

said deck having a third wheel cutout and fourth wheel cutout proximate to a second distal end of said deck;

said third wheel cutout and fourth wheel cutout being equidistant from said second distal end;

said third wheel cutout being coincident with said first lateral side of said deck and said fourth wheel cutout being coincident with said second lateral side of said deck;

said first truck assembly affixed to a first planar surface of said deck, coincident with said midline and proximate to said first distal end of said deck;

said first truck assembly affixed with an axle disposed perpendicular to said midline;

said first truck assembly having a pivot-axis angle that is angled toward said first distal end from said first planar surface of said deck;

said second truck assembly affixed to said first planar surface of said deck, coincident with said midline and proximate to said second distal end of said deck;

said second truck assembly affixed with an axle disposed perpendicular to said midline;

said second truck assembly having a pivot-axis angle that is angled toward said second distal end from said first planar surface of said deck;

wherein said deck further comprises a first axle cutout and a second axle cutout;

said first axle cutout and second axle cutout being equidistant from said second distal end;

said first axle cutout being coincident with said first lateral side; and said second axle cutout being coincident with said second lateral side.

2. The standup paddle-board skateboard apparatus of claim 1 wherein said pivot-axis angle of said first truck assembly exceeds 65-degrees and said pivot-axis angle of said second truck assembly exceeds 65-degrees.

3. The standup paddle-board skateboard apparatus of claim 1 wherein said pivot-axis angle of said first truck assembly exceeds 70-degrees and said pivot-axis angle of said second truck assembly exceeds 70-degrees.

4. The standup paddle-board skateboard apparatus of claim 1 wherein said first axle cutout and said second axle cutout are offset forward of an axle of said second truck.

5. The standup paddle-board skateboard of claim 1 wherein said first axle cutout and said second axle cutout are offset forward of said axle by a distance of at least 2.54 cm (linch).

6. The standup paddle-board skateboard apparatus of claim 1 further comprising a first wedge and a second wedge, wherein said first wedge is disposed between said first planar surface of said deck and said first truck assembly; and said second wedge is disposed between said first planar surface of said deck and said second truck assembly.

7. The standup paddle-board skateboard apparatus of claim 1 wherein said handle further comprises a thru-hole having a substantially oblong shape with the length of said oblong shape being parallel with a midline of the deck.

* * * * *